US009426583B2

(12) United States Patent
Hartlev

(10) Patent No.: US 9,426,583 B2
(45) Date of Patent: Aug. 23, 2016

(54) MEMBER WITH AN ADHESIVE SURFACE

(75) Inventor: Klaus Hartlev, Roskilde (DK)

(73) Assignee: GN Otometrics A/S, Taastrup (DK)

( * ) Notice: Subject to any disclaimer, the term of this patent is extended or adjusted under 35 U.S.C. 154(b) by 0 days.

(21) Appl. No.: 13/439,798

(22) Filed: Apr. 4, 2012

(65) Prior Publication Data

US 2013/0256470 A1 Oct. 3, 2013

(30) Foreign Application Priority Data

Mar. 27, 2012 (DK) ..... 2012 70151
Mar. 27, 2012 (EP) ..... 12161498

(51) Int. Cl.
*H04R 29/00* (2006.01)
*H04R 25/00* (2006.01)

(52) U.S. Cl.
CPC ..... *H04R 25/30* (2013.01)

(58) Field of Classification Search
CPC ..... H04R 25/70
USPC ..... 248/683, 205.3, 467; 381/60, 380, 23.1, 381/322, 324, 325, 326, 328, 382, 58, 330; 600/559; 73/585
See application file for complete search history.

(56) References Cited

U.S. PATENT DOCUMENTS 5,699,435 A * 12/1997 Killion ..... 381/60
5,913,309 A * 6/1999 Sheehan et al. ..... 128/846
6,157,728 A * 12/2000 Tong et al. ..... 381/331
6,427,293 B1 * 8/2002 Bowes, Jr. ..... 24/304
8,577,050 B2 * 11/2013 Margolis et al. ..... 381/60
2005/0147269 A1 * 7/2005 Oliveira et al. ..... 381/382
2005/0157899 A1 * 7/2005 Raviv et al. ..... 381/322
2008/0304674 A1 * 12/2008 David Ho et al. ..... 381/60
2009/0123015 A1 * 5/2009 Saltykov ..... 381/328
2009/0190786 A1 * 7/2009 Miskiel et al. ..... 381/380
2009/0316921 A1 * 12/2009 Lloyd et al. ..... 381/60
2010/0092001 A1 4/2010 Saltykov et al.
2011/0082386 A1 * 4/2011 Sheraton, Sr. ..... 600/559

FOREIGN PATENT DOCUMENTS

CN 101897201 A 11/2010
CN 102342834 A 2/2012

OTHER PUBLICATIONS

Extended European Search Report dated Aug. 13, 2012 for EP Patent Application No. 12161498.6.
Second Technical Examination dated Apr. 25, 2013, for Danish Patent Application No. PA 2012 70151.
1st Technical Examination dated Oct. 31, 2012, for Danish Patent Application No. PA 2012 70151.
Notification of First Office Action and Search Report dated Sep. 25, 2015, for corresponding Chinese Patent Application No. 201310102519.6, 14 pages.

* cited by examiner

*Primary Examiner* — Terrell McKinnon
*Assistant Examiner* — Michael McDuffie
(74) *Attorney, Agent, or Firm* — Vista IP Law Group, LLP

(57) ABSTRACT

A member includes a fastener for removable fixation of a housing of a hearing aid, and a hole for removable insertion of a sound tube of the hearing aid in sound proof engagement with the member.

16 Claims, 10 Drawing Sheets

MEMBER WITH AN ADHESIVE SURFACE

RELATED APPLICATION DATA

This application claims priority to and the benefit of European patent application No. 12161498.6, filed on Mar. 27, 2012, pending, and Danish patent application No. PA 2012 70151, filed on Mar. 27, 2012, pending, the disclosures of both of which are expressly incorporated by reference herein.

FIELD OF THE APPLICATION

A new member is provided for use in a test box for testing hearing aids.

BACKGROUND

It is known to test hearing aid in a test box for quality control and/or for adjustment purposes.

In the test box, the sound output of the hearing aid to be tested is connected to a test microphone in a soundproof manner using an adaptor and a coupler such as a 2 cc coupler. One or more loudspeakers in the test box generate sound during the test for reception and processing by the hearing aid to be tested and the sound output by the hearing aid is guided towards test microphone in the test box. A reference microphone is positioned adjacent a microphone of the hearing aid to be tested in order to measure the actual level of the sound received by the hearing aid.

The test box is sound proof so that sound from the surroundings is prevented from interfering with the testing of the hearing aid.

SUMMARY

In order to properly test a hearing aid, it is important that the sound output of the hearing aid to be tested is connected to the test microphone in a soundproof manner.

A behind-the-ear (BTE) hearing aid has a hearing aid housing worn behind the pinna of the user during use, and a sound tube for acoustical or electrical transmission of sound from a sound output of the hearing aid housing to an earpiece shaped for insertion into the ear canal of the user. The hearing aid housing may accommodate a receiver for outputting sound for acoustic transmission to the earpiece; or, the receiver may be accommodated in the earpiece in which case an electronic sound signal output by a processor in the hearing aid housing is transmitted electrically to the receiver in the earpiece inserted in the ear canal of the user during use.

During test of a BTE hearing aid, an output end of the sound tube is connected to an metal guiding member (which may comprise a 2 cc coupler) in the test box that guides sound generated by the hearing aid towards the test microphone. In an embodiment, the metal guiding member may be made of brass with dull chromium. The connection between the sound tube and the guiding member has to be sound proof so that sound generated by the test box does not enter the guiding member directly, and so that sound generated by the hearing aid cannot avoid entering the guiding member.

The guiding member is provided with an metal adaptor comprising an opening substantially larger than the average output end of the sound tube in order to accommodate a wide range of output ends. The diameter of the opening of the adaptor may be twice the diameter of the average output end. In order to obtain a sound proof connection between the sound tube and the guiding member, the insertion of the output end of the sound tube with or without the earpiece as desired in the adaptor is achieved using a suitable wax, such as Blu tack, which is a reusable putty-like pressure-sensitive adhesive used for attaching paper items to walls. The adhesive material is applied to the output end of the sound tube and fixed to the adaptor around the opening when the output end of the sound tube has been inserted into the opening of the adaptor. The adaptor is subsequently inserted into the guiding member in a snap fit coupling.

In order to obtain a sound proof connection, a skilled person has to apply the suitable wax, and applying the suitable wax is tedious, labour-intensive and time-consuming. A skilled person may achieve the sound proof connection in 2-4 minutes.

After interconnecting the sound tube and the adaptor, the hearing aid housing may also be attached to the adaptor using more of the suitable wax to fix the housing to the adaptor. The reference microphone is positioned adjacent the current position of the microphone of the hearing aid.

Thus, there is a need for an improved way of interconnecting a sound output of a BTE hearing aid with a test microphone in a test box in a reproducible and repeatable manner. Further, the suitable wax is normally reused and therefore becoming contaminated by the multiple usages. This may pose a health risk to the skilled person applying the suitable wax and a health risk to the patient (or the next patient). Thus, there is also a need to provide a more sterile testing of the hearing aid. Additionally, the reuse of the suitable wax may change the transmission properties of the suitable wax. Thus, there is a further need to make testing of the hearing aid reproducible and repeatable.

Accordingly, a member is provided with a fastener for removable fixation of a housing of a hearing aid, and a hole for removable insertion of a sound tube of the hearing aid in sealing engagement with the member. The member may replace the abovementioned adaptor in order to ensure a sound proof connection between the member and the guiding member. Using the member, interconnection of the sound tube and the member and fixation of the housing to the member may be accomplished in under a minute e.g. in the order of 30 seconds.

The fastener may comprise mechanical fastening means for removably gripping and holding the hearing aid housing around a part of the housing, for example shaped as a fork.

The fastener may comprise an adhesive used for forming an adhesive surface of the member, such as a planar adhesive surface, suitable for removably mounting the hearing aid housing to the adhesive surface.

The adhesive is preferably a reusable, pressure-sensitive adhesive so that the hearing aid housing is easily and safely fixed to the adhesive surface simply by pressing the housing lightly onto the adhesive surface thereby eliminating the need to non-reproducibly attaching the housing to the guiding member using blu-tack. Further, in combination with the hole for removable insertion of a sound tube in a sound proof engagement, the need for blu-tack is eliminated.

Further, the adhesive of the adhesive surface is preferably a low-tack adhesive that allows the hearing aid housing to be easily attached to and removed from the adhesive surface without leaving marks or residue on the hearing aid housing.

In order to protect the adhesive surface from contamination and to maintain the desired adhesive features of the adhesive surface during storage, the adhesive surface is preferably provided with a protection sheet during manufacture of the member. The protection sheet is easily removed from the adhesive surface before fixation of the hearing aid housing to the adhesive surface. In an embodiment, the protective sheet is made of paper coated with polyethylene. In another embodiment, the protective sheet is made of polytetrafluoroethylene (PTFE) or polyethylene (PE).

The adhesive may for example be formed by a double coated foam tape as for example manufactured by 3M.

For a BTE hearing aid with the receiver in the earpiece, i.e. a RIE hearing aid (RIE=Receiver In the Ear), the earpiece is inserted in the hole of the member, while for a BTE hearing aid with the receiver in the hearing aid housing, the output end of the sound tube may have a connector mating the earpiece so that the earpiece is removably fastened to the sound tube, and the connector may be inserted in the hole of the member for testing of the hearing aid without the earpiece. In both cases, an output end of the sound tube is said to be inserted into the hole of the member for sound proof interconnection of the sound tube with the member.

The output end of the sound tube, e.g. a connector for an earpiece, or the earpiece itself, may be made of a flexible and resilient material, such as silicone, etc, so that an outer circumference of the output end of the sound tube is automatically fitted to the shape of the hole, during insertion of the output end of the sound tube into the hole, whereby the output end is connected to the member in a sound proof way in a simple and easy operation.

A part of the member accommodating the hole may be made of a flexible and resilient material, such as thermoplastic elastomers, thermoplastic polyurethanes, silicone, rubber, etc, so that the hole is flexible and may expand and automatically fit to the output end of the sound tube when the sound tube is inserted in the hole, whereby the output end is connected to the member in a sound proof way in a simple and easy operation without the need for applying suitable wax, such as Blu Tack, for provision of a sound proof interconnection.

The part of the member made by a flexible and resilient material may be surrounded and held by a part of the member made of a hard material, such as Acrylonitrile Butadiene Styrene (ABS), Polycarbonate Acrylonite Butadiene Styrene (PC/ABS), nylon, Polyamide (PA), etc.

For example, a hard part of the member may be made of ABS while the flexible and the resilient part of the member may be made of a thermoplastic elastomer.

A part of the member or all parts of the member may be made by injection moulding.

The two parts of the member, i.e. the hard part and the flexible and resilient part, may be fixed to each other by injection moulding one part onto the other part; or the two parts of the member may be fixed to each other by gluing, ultrasound welding, bonding, etc.

For example, the flexible and resilient material may be injection moulded onto the hard material.

At least a part of an outer surface of the member is constituted by an adhesive surface, for example a part of the member made of a hard material may have the adhesive surface while a part of the member made of a flexible and resilient material and containing the hole has a non-adhesive surface.

The member may be a planar member with a maximum height that is less than half its maximum width, e.g. shaped like a disc, a plate, etc.

The member may have a substantially circular circumference.

In the test box, sound output from the output end of the sound tube has to be guided to the test microphone without disturbances from other sounds, such as the sound generated by the loudspeaker(s) in the test chamber or sounds from the surroundings of the test chamber. Therefore, a guiding member is provided in the test box, typically a tubular guiding member with a circular cross-section, positioned so that the test microphone is located and enclosed at one end of the guiding member, while the member is mounted to the other end of the guiding member in a sound proof way.

The member may have a central protrusion comprising the hole, wherein the central protrusion is configured for insertion into a tubular member in a sound proof way for conduction of sound emitted from the sound tube inside the tubular member towards the test microphone.

The central protrusion may have a circumferential ridge protruding from the surface abutting a surface of the guiding member when the member is mounted to the guiding member, whereby the member and the guiding member are interconnected with a press fit.

The member has a central depression comprising the hole whereby the plane of the central depression may be different from the plane of the member containing the fastener whereby mutually non-interfering mounting is facilitated of the hearing aid housing to the fastener and the output end of the sound tube in the hole of the member.

Part of the central depression may be made of the hard material.

Preferably, the central depression is non-adhesive.

The central depression may define an inner circumference of the adhesive surface.

The inner circumference may be substantially circular.

In accordance with some embodiments, a member includes a fastener for removable fixation of a housing of a hearing aid, and a hole for removable insertion of a sound tube of the hearing aid in sound proof engagement with the member.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the advantages and objects described herein are obtained, a more particular description of the embodiments will be rendered, which are illustrated in the accompanying drawings. These drawings depict only typical embodiments and are not therefore to be considered limiting of its scope.

DETAILED DESCRIPTION

Figure 1:
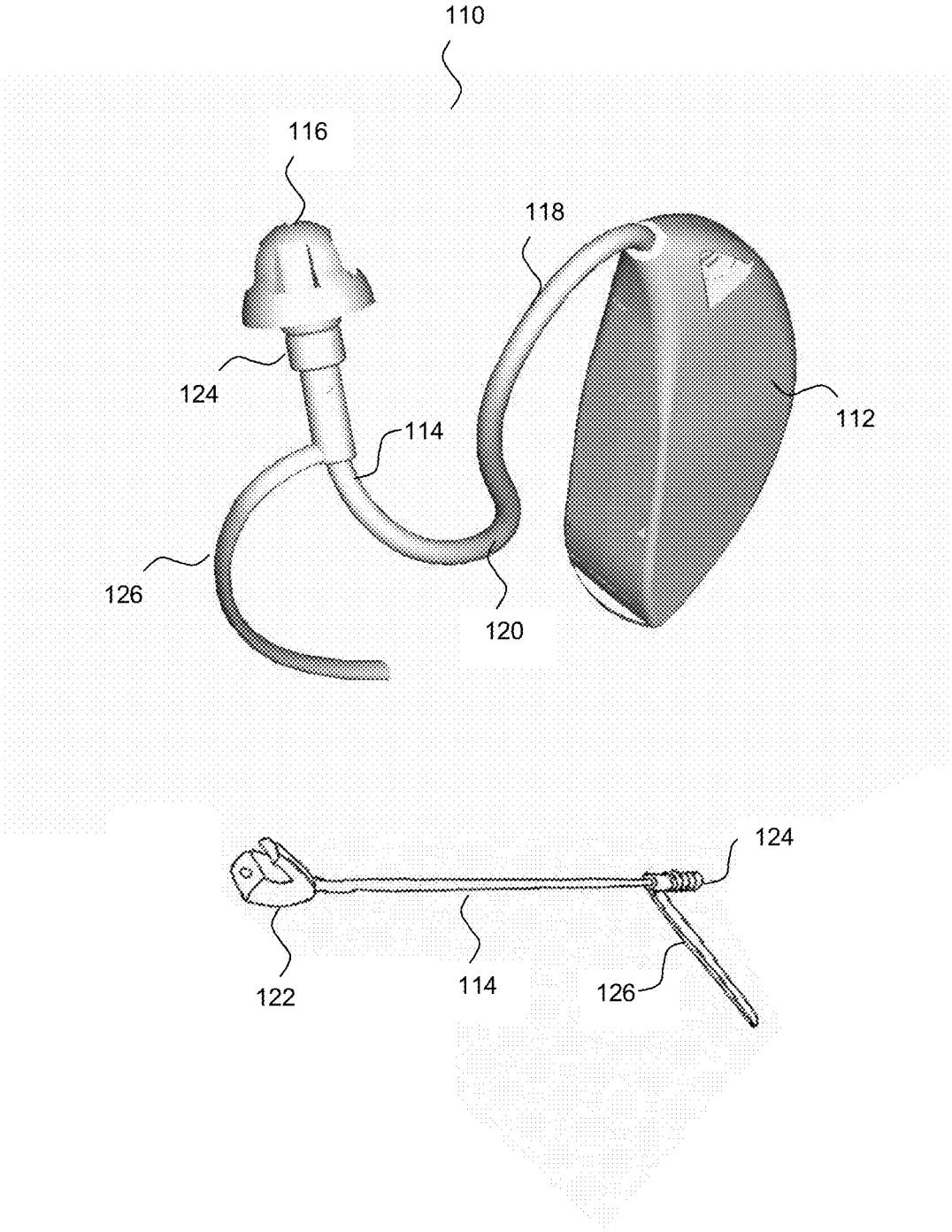
FIG. 1 is a perspective view of a prior art BTE hearing aid with an earpiece, and the sound tube.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. The claimed invention may be embodied in different forms not shown in the accompanying drawings, and the claimed invention should not be construed as limited to the examples set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

The new member will now be described more fully hereinafter with reference to the accompanying drawings, in which various examples are shown.

FIG. 1 shows in perspective a BTE hearing aid 110 of the well-known type wherein sound signals propagate as acoustic signals from a receiver positioned in a hearing aid housing 112 worn behind the ear and through a sound tube 114 into the ear canal. Such a BTE hearing aid 110 is for example disclosed in EP 1 448 014.

The hearing aid housing 112 contains a battery, a microphone, a processor, and a receiver (not shown) for generating sound that is input into the sound tube 114.

In order to position the sound tube 114 securely and comfortably in the ear canal, an earpiece 116 is attached to the sound tube 114 for insertion into the ear canal of the user.

The sound tube 114 has a pre-formed shape for conducting sound from the hearing aid housing 112 to the ear canal (not shown). The pre-formed shape of the sound tube 114 includes a first bend 118 extending from the case over the top of the ear of the user and a second bend 120 extending from an outside of the ear into an ear canal of the user when the hearing aid 110 is worn by the user.

The earpiece 116 is configured to fit within the ear canal and, preferably, allows sounds outside and within the ear to pass through the ear canal around the earpiece.

A first end of the sound tube 114 is attached to a first connector 122 for coupling of the sound tube 114 to the BTE housing 112 containing the electronics of the hearing aid 110, and a second end of the sound tube 114 is attached to a second connector 124 for coupling of the sound tube 114 to the earpiece 116. The sound tube 114 is flexible so that the sound tube 114 is allowed to bend and provide the required arcuate propagation path of the sound from the receiver output.

The second connector 124 comprises a plug to be connected with the earpiece 116 for attachment of the sound tube 114 to the earpiece.

Further, the hearing aid 110 has an arcuate, preferably resilient, fibre 126 with one end that is connected to the second connector 124. The fibre 126 is adapted for abutting a surface of the outer ear when the earpiece 116 has been inserted in the ear canal thereby providing retention of the earpiece 116 in the ear canal of the user.

Figure 2:
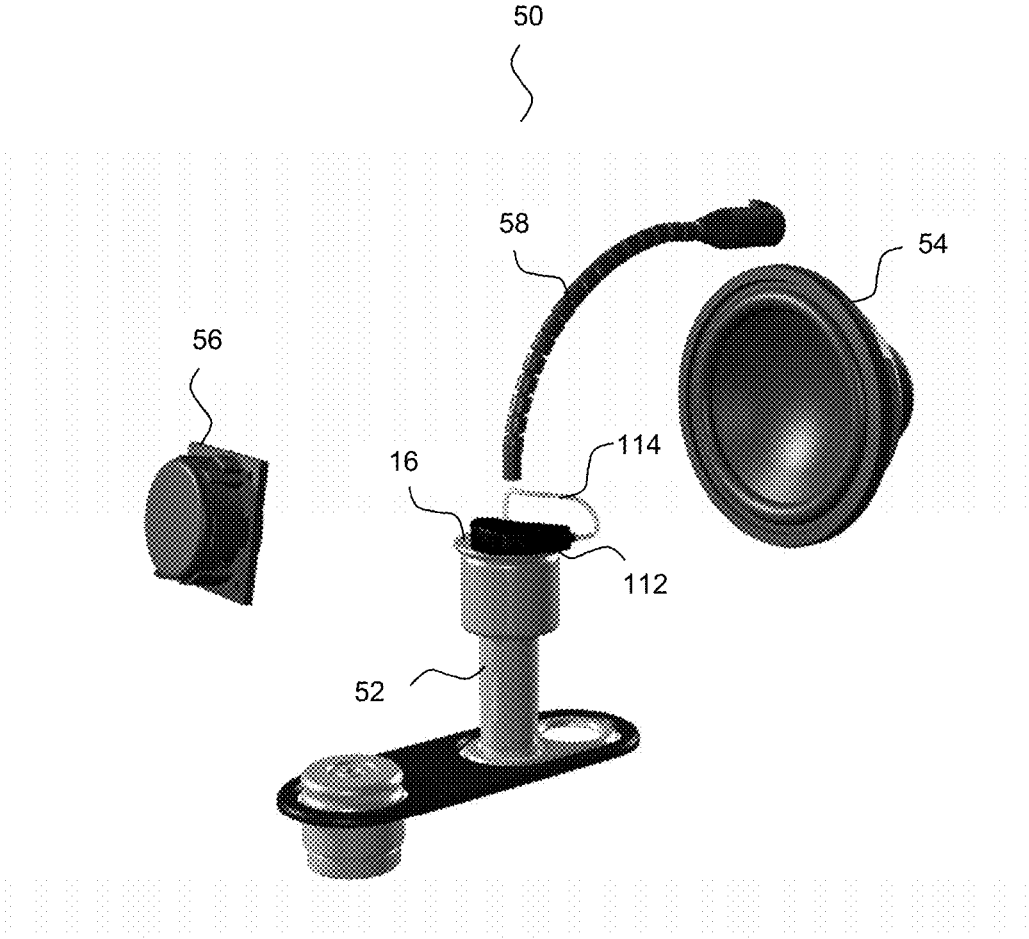
FIG. 2 is a schematic view of internal components of at test box.
Figure 3:
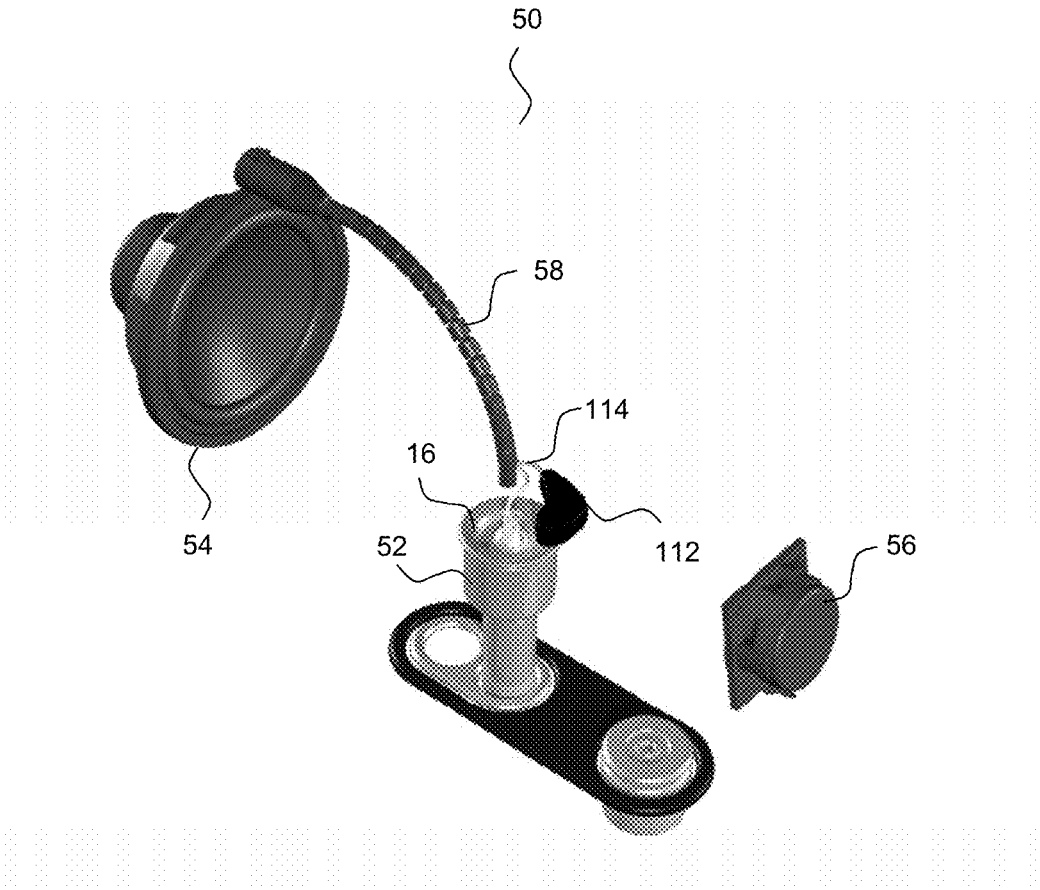
FIG. 3 is a schematic view of internal components of at test box seen from another angle.

From different viewing angles, FIGS. 2 and 3 show internal parts mounted in a test box for quality control and/or for adjustment of hearing aids. The walls of the test box have been left out so that the internal parts are visible.

The test box 50 comprises a test microphone (not visible) positioned below a guiding member 52 possibly comprising a 2 cc coupler, for reception and recording sound output by the hearing aid 110 to be tested.

The member 10 is positioned at the upper end of the guiding member 52 and, except for the hole 14, closes the upper end of the guiding member 52 in a soundproof manner by insertion of a protrusion 24 inside the guiding member 52.

The hearing aid housing 112 is positioned on a planar adhesive surface 16 of the member 10 and the second connector 124 of the sound tube 114 is inserted into the hole 14 of the member 10 in a soundproof way and thereby sound output by the hearing aid 110 is transmitted without disturbances to the test microphone of the test box.

The adhesive is a reusable, pressure-sensitive adhesive so that the hearing aid housing 112 is easily and safely fixed to the adhesive surface 16 simply by pressing the housing 112 lightly onto the adhesive surface 16.

Further, the adhesive of the adhesive surface is preferably a low-tack adhesive that allows the hearing aid housing 112 to be easily attached to and removed from the adhesive surface 16 without leaving marks or residue on the hearing aid housing 112.

In order to protect the adhesive surface 16 from contamination and to maintain the desired adhesive features of the adhesive surface 16 during storage, the adhesive surface 16 is preferably provided with a protection sheet during manufacture of the member. The protection sheet is easily removed from the adhesive surface 16 before fixation of the hearing aid housing 112 to the adhesive surface 16.

The adhesive may for example be formed by a double coated foam tape as for example manufactured by 3M.

When the test has been finished, the second connector 124 is easily retracted from the hole 14, and the hearing aid housing 112 is easily removed from the adhesive surface 16. The member 10 may be re-used for testing of another hearing aid; or, the member 10 may be discarded after use.

A front loudspeaker 54 and a rear loudspeaker 56 are positioned in the test box to generate sound during the test for reception and processing by the hearing aid 110 to be tested and the sound output by the hearing aid 110 is guided towards the test microphone. A reference microphone (not visible) is positioned at the end of a flexible hose 58 containing electrical wires for transmission of electrical signals from the reference microphone, so that the reference microphone can be positioned adjacent a microphone of the hearing aid 110 to be tested in order to measure the actual level of the sound received by the hearing aid 110.

The test box 50 is sound proof so that sound from the surroundings is prevented from interfering with the testing of the hearing aid 110.

Thus, the member 10 facilitates easy and convenient soundproof interconnection of a sound output of a BTE hearing aid 110 with a guiding member for guiding sound output by the hearing aid to the test microphone in the test box 50 and simultaneous fixation of the hearing aid housing 112 in an appropriate position in the test box 50 with relation to loudspeakers and the reference microphone in the test box thereby facilitating repeatable measurements.

Figure 5:
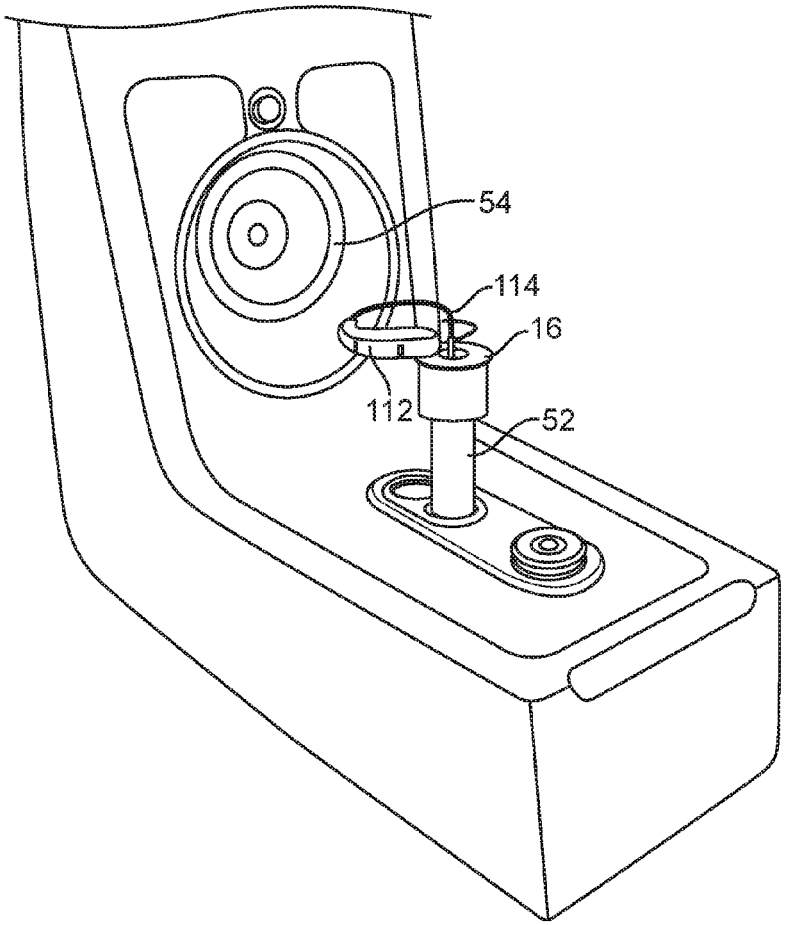
FIG. 5 is a photo of utilisation of a new member in a test box.

FIG. 5 shows a photograph of a test box containing a guiding member 52, a hearing aid housing 112 and sound tube 114, a new member having an adhesive surface 16, and a loudspeaker 54.

Figure 4:
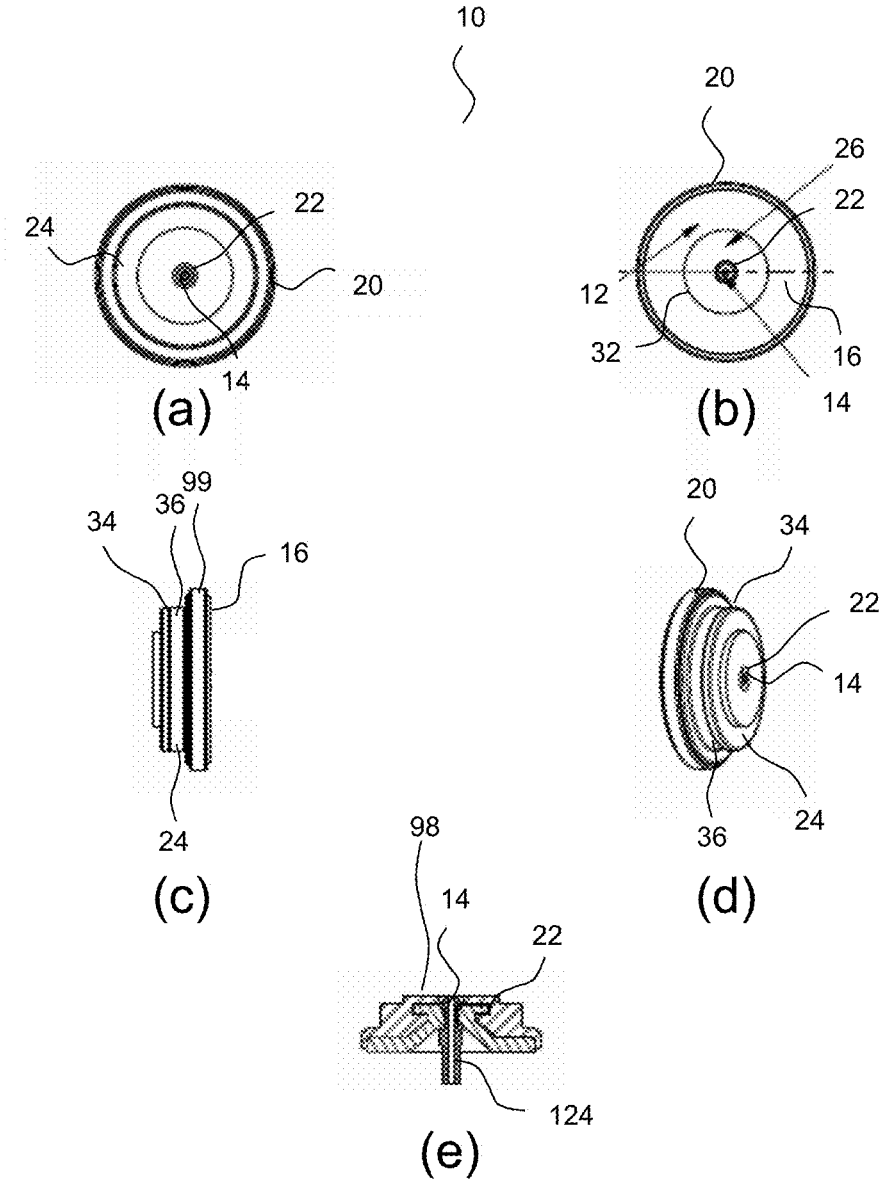
FIG. 4 shows various views of a new member.
Figure 6:
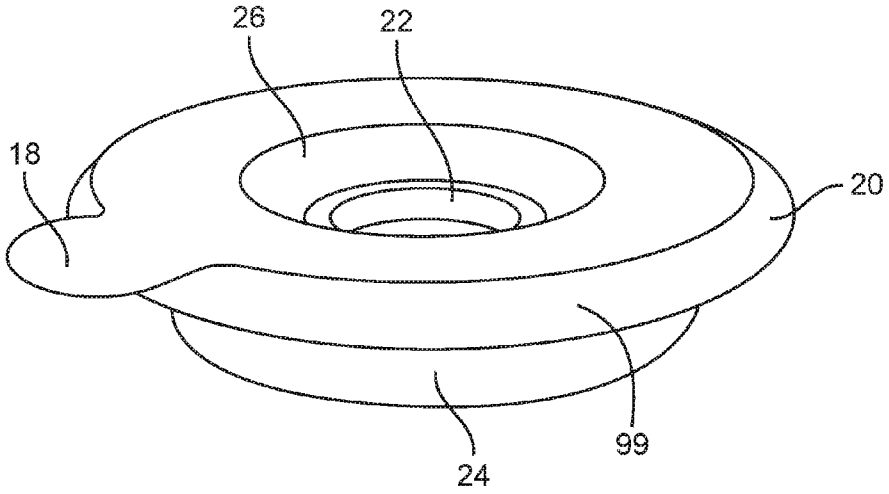
FIG. 6 shows an embodiment of the new member containing the protective sheet.

FIG. 4 shows the member 10 in more detail in various side and elevational views and in perspective and cross-section, i.e. FIG. 4(*a*) is a bottom view of the member 10, FIG. 4(*b*) is a top view of the member, FIG. 4(*c*) is a side view of the member, FIG. 4(*d*) shows a bottom view of the member 10 in perspective, and FIG. 4(*e*) shows the part 22 made of flexible material in cross-section. FIG. 6 shows an image of the member 10 comprising a protective sheet 18 removably positioned on an adhesive surface to be removed before fixation of the housing 112 to the member 10.

The illustrated member 10 has the shape of a circular disc with protrusions and depressions and an outer circumference 20. The hole 14 of the member 10 is formed centrally in the member 10, and a part 22 of the member 10 accommodating the hole 14 is made of a flexible, resilient thermoplastic elastomer, so that the circumference of the hole 14 is flexible and may expand and automatically fit to the second connector 124 of the sound tube 114 when the sound tube 114 is inserted in the hole 14, whereby the output end of the sound tube 114 is connected to the member 10 in a sound proof way and in a simple and easy operation without the need for applying further material, such as Blu Tack, for provision of a sound proof interconnection.

The central part 22 of the member made by a flexible and resilient thermoplastic elastomer is surrounded and held by a part of the member made of the hard material ABS.

The member 10 is made by injection moulding.

The two parts of the member 10 are fixed to each other by injection moulding one part onto the other part.

The member 10 has a central protrusion 24 comprising the hole 14, wherein the central protrusion 24 is configured for insertion into a guiding member 52 in a sound proof way for conduction of sound emitted from the sound tube 114 inside the tubular member 52 towards the test microphone.

The central protrusion 24 may have a circumferential ridge 34 protruding from the circumferential surface 36 abutting a surface of the guiding member 52 when the member 10 is mounted to the guiding member 52, whereby the member 10 and the guiding member 52 are interconnected with a press fit (snap fit). In an embodiment, the guiding member 52 may have a groove matching the ridge 34 of the member 10 such that when the central protrusion 24 is inserted into the guiding member 52, the ridge 34 of the central protrusion 24 and the groove of the guiding member 52 may act as a tongue and groove. In an embodiment, the guiding member comprises a groove in which an O-ring may be contained such that when the central protrusion 24 is inserted into the guiding member 52, the ridge 34 of the central protrusion 24 and O-ring in the groove of the guiding member 52 may interconnect in a sound proof manner.

The member 10 has a central depression 26 comprising the hole 14 whereby the surface of the part of the member comprising the hole 14 is separated from the surface of the adhesive surface 16 whereby mutually non-interfering mounting is facilitated of the hearing aid housing 112 to the member 10 and the second connector 124 of the sound tube 114 in the hole 14 of the member 10.

Part of the central depression 26 surrounding the flexible material with the hole 14 is made of the hard material ABS. The surface of the central depression 22 is non-adhesive.

In FIG. 4(*b*), the central depression 26 defines an outer circumference 32 of the non-adhesive flexible and resilient surface 22. Reference 12 in FIG. 4(*b*) may be a fastener such as an adhesive surface 16.

FIG. 4(*c*) shows the hard material such as ABS in reference 99.

In FIG. 4(*e*), the inserted second connector 124 of the sound tube 114 is inserted such that it is flush with an end 98 of the member 10 facing the microphone positioned in the guiding member 52. Thereby is achieved a reproducible distance between the inserted second connector and the microphone positioned in the guiding member 52.

FIG. 6 shows an embodiment of the member 10 containing a protective sheet 18. The hard material part is shown as reference 99. The outer circumference of the member is referenced 20. The flexible material part is reference 22. The protrusion of the member is reference 24, and the central depression of the member is referenced 26.

Figure 7:
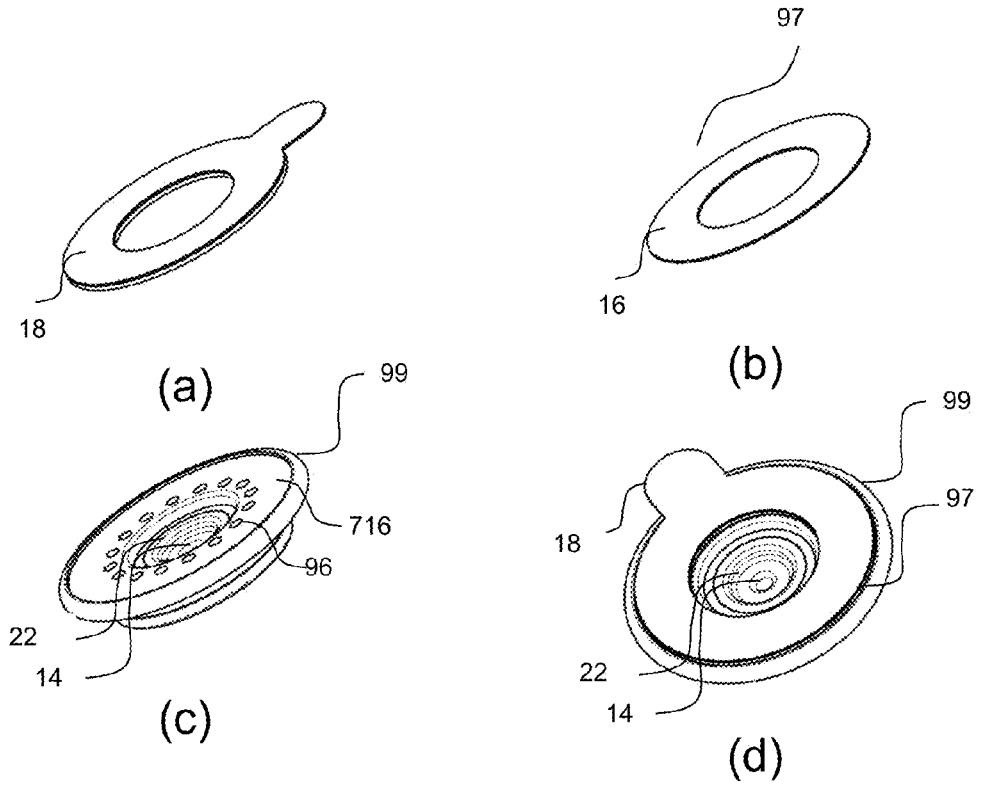
FIG. 7 shows an embodiment in which multiple parts of the new member are shown individually and in combination.

FIG. 7 shows parts of the member 10 individually and in combination in perspective. FIG. 7(*a*) shows a protective sheet 18. FIG. 7(*b*) shows a double coated foam tape 97 providing at one side an adhesive surface 16 and at another side, opposite to the adhesive surface 16, a second adhesive surface for fixing the double coated foam tape 97 to a surface 716 of the hard material part 99 of the member 10. FIG. 7(*c*) shows a hard material part 99 of the member 10, a flexible material part 22 of the member 10 and a hole 14. The holes 96 placed in a concentric circle in the hard material part 99 of the member 10 are in an embodiment provided to prevent suction in the hard material part 99. FIG. 7(*d*) shows an embodiment of the member 10 comprising the protective sheet 18, the double coated foam tape 97, the hard material part 99, the flexible material part 22, and the hole 14.

Figure 8:
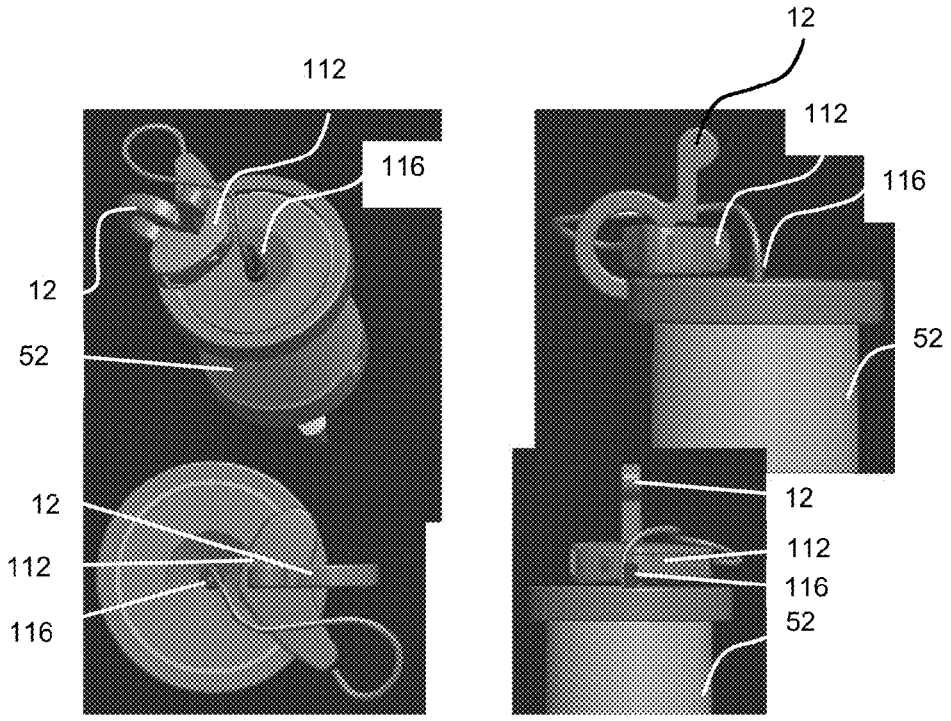
FIG. 8 shows an embodiment where the fastener is embodied as a clamp.

FIG. 8 shows the member 10 in more detail in various side and perspective views in an embodiment wherein the fastener comprises mechanical fastening means for removably gripping and holding the hearing aid housing around a part of the housing. In this embodiment, the fastener is embodied as a clamp 12. In FIG. 8, 52 represents the guiding member, 112 the hearing aid housing and 116 the earpiece inserted into the hole 14 in a soundproof manner.

Figure 9:
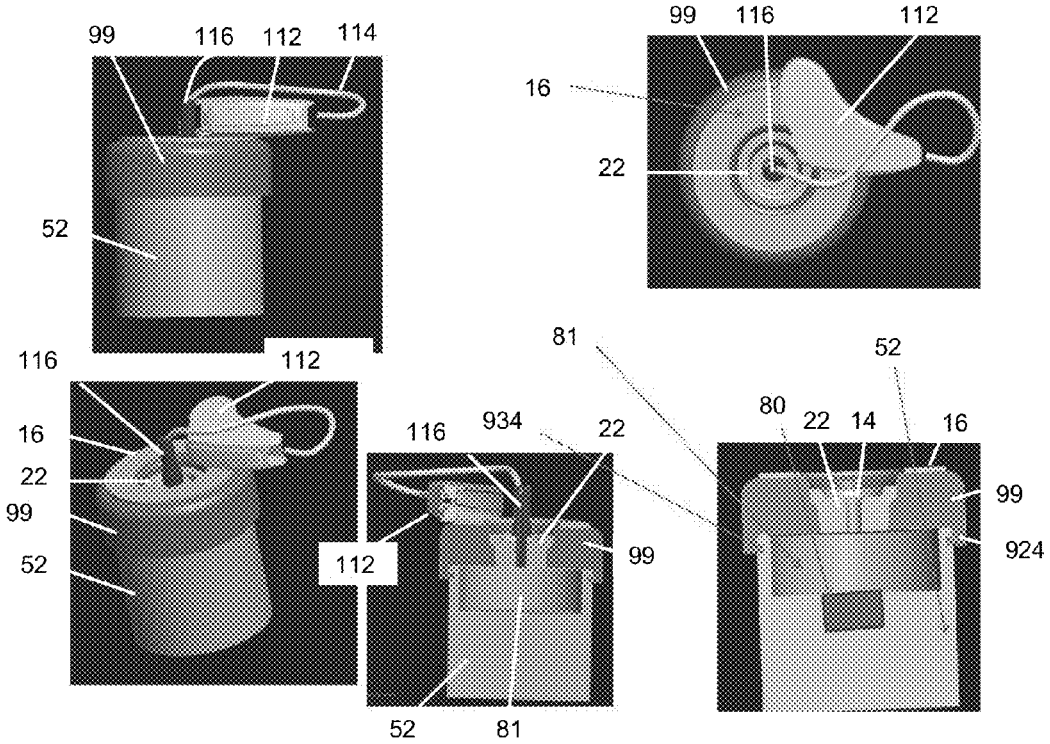
FIG. 9 shows an embodiment, wherein the new member encloses the guiding member (comprising a 2 cc coupler).

FIG. 9 shows an embodiment, wherein the member 10 encloses the guiding member 52 in various side and perspective and cross-sectional views. In this embodiment, the guiding member 52 is inserted into the member 10 which thereby encloses the guiding member 52 in a sound proof manner when a earpiece 116 of a hearing aid is inserted into the hole 14 of the member 10. In this embodiment, 112 represents the housing, 114 represents the sound tube, 116 represents the earpiece, 99 represents the hard material part of the member 10, 16 represents the adhesive material surface, 22 represents the flexible and resilient part of the member 10, 80 represents the test microphone, 81 represents a 2 cc volume i.e. a 2 cubic centimeter volume of a 2 cc coupler contained in the guiding member 52.

The member 10 comprises a circumferential protrusion 924 made of the same material as the hard material part 99. The guiding member 52 is inserted into the member 10. In an embodiment, the guiding member 52 comprises a groove 934 in which an O-ring may be contained. Thereby, an inner surface of the circumferential protrusion 924 and the guiding member 52 may interconnect in a sound proof manner via the O-ring, when the member 10 encloses the guiding member 52.

In an embodiment, the protrusion 924 may comprise a circumferential ridge 934 corresponding to the O-ring above. The circumferential ridge 934 may protrude from the inner surface of the circumferential protrusion 924. In this embodiment, the guiding member 52 comprises a groove matching the ridge of the protrusion 924 such that when the member 10 encloses the guiding member 52, the ridge 934 of the outer circumferential protrusion 924 and the groove of the guiding member 52 may act as a tongue and groove.

Figure 10:
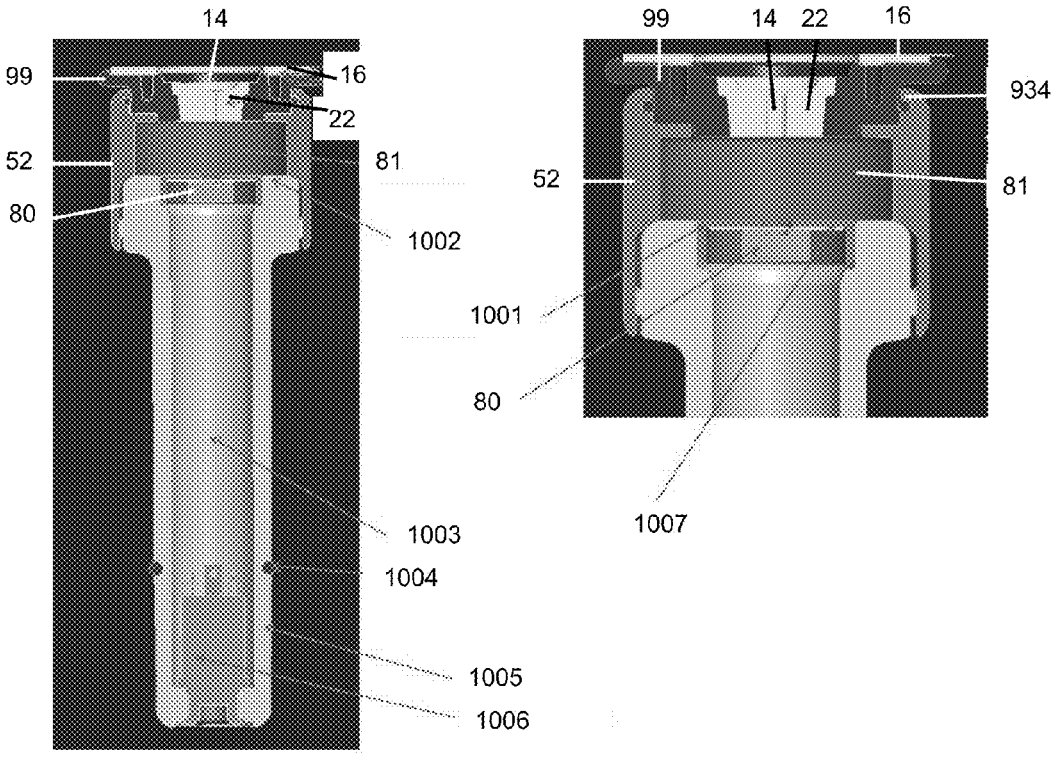
FIG. 10 shows an embodiment of the guiding member 52 in FIGS. 2 and 3 together with the new member of FIG. 4.

FIG. 10 shows an embodiment of the guiding member 52 of FIGS. 2 and 3 together with the new member of FIG. 4 in cross-sectional view.

14 represents the hole in the new member 10, 16 represents the adhesive surface, 22 represents the flexible and resilient material part, 99 represents the hard material part, 81 represents the 2 cubic centimeter volume of the 2 cc coupler of the guiding member 52, 1005 represents a housing containing the test microphone 80, 1002 represents a part of the housing 1005 containing the test microphone 80, 1003 represents a volume/space for wires and/or cables from the microphone 80 to the test box, the connection between which is accommodated by a connector 1006, 1004 represents an O-ring providing sound proof connection between the housing 1005 containing the test microphone 80 and the test box, 1001 represents a coupler between the two cubic centimeter volume 81 and the test microphone 80, 1007 represents fixation means for fixing the microphone 80 to the housing 1005 such as e.g. tape and/or glue and/or a clamp. 934 represents the sound proof interconnection between the member 10 and the 2 cc coupler part of guiding member 52.

In an embodiment, the O-ring 1004 may be substituted by a ridge in the housing 1005 matching a groove in the test box in a tongue and groove manner such as to ensure a sound proof connection between the housing 1005 and the test box.

Aspects of one or more embodiments are disclosed in the following items:

1. A member (10) with a fastener (12) for removable fixation of a housing (112) of a hearing aid (110), and a hole (14) for removable insertion of a sound tube (114) of the hearing aid (110) in sound proof engagement with the member (10).

2. A member (10) according to item 1, wherein the fastener (12) comprises an adhesive.

3. A member (10) according to item 2, wherein the fastener (12) comprises a planar adhesive surface (16).

4. A member (10) according to item 3, with a protection sheet (18) removably positioned on the adhesive surface (16) to be removed before fixation of the housing (112).

5. A member (10) according to any of the previous items, wherein at least a part of the member (10) accommodating the hole (14) is made of a resilient material so that the hole (14) is flexible and may expand and adapt to the sound tube (114) when the sound tube (114) is inserted in the hole (14).

6. A member (10) according to item 5, wherein the resilient material is selected from the group consisting of thermoplastic elastomers, thermoplastic polyurethanes, silicone, and rubber.

7. A member (10) according to item 5 or 6, wherein a part of the member (10) defining an outer circumference (20) of the member (10) is made of a hard material, and wherein the part (22) of the member made of resilient material is fixed to the hard material.

8. A member (10) according to item 7, wherein the part of the member (10) made of a hard material encloses the part (22) of the member made of resilient material.

9. A member (10) according to item 7 or 8, wherein the adhesive surface (16) is contained on a surface of the member (10) made of hard material.

10. A member (10) according to any of items 7-9, wherein the hard material is selected from the group consisting of ABS, PC/ABS, nylon, and PA.

11. A member (10) according to item 10, wherein the hard material is ABS and the resilient material is a thermoplastic elastomer.

12. A member (10) according to any of the previous items, wherein at least a part of the member (10) is made by injection moulding.

13. A member (10) according to item 12, wherein the resilient material is fixed to the hard material by injection moulding the resilient material onto the hard material.

14. A member (10) according to any of the previous items, wherein the member (10) is a planar member (10) with a maximum height that is less than half its maximum width.

15. A member (10) according to item 14, wherein the member (10) is substantially circular.

16. A member (10) according to any of the previous items, having a central protrusion (24) comprising the hole (14), and wherein the central protrusion (24) is configured for insertion into a tubular member for conduction of sound emitted from the sound tube (114) inside the tubular member.

17. A member (10) according to any of the previous items, having a central depression (26) comprising the hole (14).

18. A member (10) according to item 17 as dependent on item 5, wherein part (28) of the central depression is made of the hard material.

19. A member (10) according to item 17 or 18, wherein the central depression (26) is non-adhesive.

20. A member (10) according to any of items 17-19, wherein the central depression (26) defines an inner circumference (30) of the adhesive surface (16).

21. A member (10) according to any of items 17-19, wherein the central depression defines an outer circumference (32) of a non-adhesive surface (16).

22. A member (10) according to item 20 or 22, wherein the inner circumference (30) is substantially circular.

The invention claimed is:

1. A member for use in a procedure to test a hearing aid, the member comprising: a fastener for removable fixation of a housing of a the hearing aid relative to the member; and a hole for removable coupling a flexible sound tube of the hearing aid with the member, wherein the hole of the member is for removable insertion of an end of the flexible sound tube, wherein when the flexible sound tube is coupled with the member, the flexible sound tube is in sound proof engagement with the member; wherein the fastener is a part of the member that is a separate device from the hearing aid.

2. The member according to claim 1, wherein the fastener comprises an adhesive.

3. The member according to claim 1, wherein the fastener comprises a planar adhesive surface.

4. The member according to claim 3, further comprising a protection sheet removably positioned on the adhesive surface to be removed before fixation of the housing of the hearing aid.

5. The member according to claim 1, further comprising a first part at which the hole is located, wherein the first part is made of a resilient material so that the hole may expand and adapt to the sound tube when the sound tube is inserted in the hole.

6. The member according to claim 5, further comprising a second part defining an outer circumference of the member, wherein the second part is made of a hard material that is harder than the resilient material of the first part, and wherein the resilient material of the first part of the member is fixed to the hard material of the second part of the member.

7. The member according to claim 6, wherein the resilient material of the first part is fixed to the hard material of the second part by injection molding the resilient material of the first part onto the hard material of the second part, or vice versa.

8. The member according to claim 1, further comprising a central protrusion, wherein the central protrusion includes the hole, and wherein the central protrusion is configured for insertion into a tubular member for conduction of sound emitted from the sound tube inside the tubular member.

9. The member according to claim 1, further comprising a central depression, wherein the central depression includes the hole.

10. The member according to claim 9, wherein a part of the central depression is made of a hard material that is harder than another part of the central depression.

11. The member according to claim 1, wherein the hearing aid includes an earpiece at an end of the flexible sound tube, and the hole of the member is for removable insertion of the earpiece of the hearing aid, and wherein when the earpiece is inserted into the hole, the flexible sound tube is coupled with the member via the earpiece.

12. The member according to claim 1, wherein the hole is external to the housing of the hearing aid and is separate from the housing of the hearing aid.

13. The member according to claim 1, wherein the member is a part of a device that is separate from the hearing aid.

14. The member according to claim 1, wherein the fastener is not a part of the hearing aid.

15. The member according to claim 1, wherein the device that is separate from the hearing aid comprises a test device.

16. The member according to claim 1, wherein the fastener is for use in the procedure to test the hearing aid.

* * * * *